United States Patent [19]

Elliott et al.

[11] Patent Number: 4,706,826

[45] Date of Patent: Nov. 17, 1987

[54] STRIKER CARRIER HAVING AN ADJUSTABLE WEAR PLATE FOR A RAILWAY COUPLER

[75] Inventors: William O. Elliott; Mary A. Glover, both of Pittsburgh, Pa.

[73] Assignee: McConway & Torley Corporation, Pittsburgh, Pa.

[21] Appl. No.: 725,664

[22] Filed: Apr. 22, 1985

[51] Int. Cl.[4] ..... B61G 9/00

[52] U.S. Cl. ..... 213/61; 105/420

[58] Field of Search ..... 213/58, 60, 61, 59; 105/420

[56] References Cited

U.S. PATENT DOCUMENTS

| | | | |
|---|---|---|---|
| 2,271,907 | 2/1942 | Wilson | 213/61 X |
| 2,807,375 | 9/1957 | Winther | 213/61 |
| 4,249,665 | 2/1981 | Kleykamp | 213/61 |
| 4,261,472 | 4/1981 | Moore et al. | 213/61 |
| 4,327,839 | 5/1982 | Kleykamp et al. | 213/61 |
| 4,333,576 | 6/1982 | Kaim | 213/61 |

*Primary Examiner*—Randolph A. Reese
*Assistant Examiner*—Glenn B. Foster
*Attorney, Agent, or Firm*—Thomas H. Murray; Clifford A. Poff

[57] ABSTRACT

A striker carrier assembly for a railway coupler is constructed to engage and support the shank of the coupler at an adjustably established elevation. For an E-type coupler, the striker carrier assembly includes a spacer retained on the stirker carrier by an overlying wear plate which includes downwardly extending lugs on opposite sides of the wear plate. For an F-type coupler, the striker carrier includes a striker casting supported by springs against a stop in a carrier basket. A spacer is held on top of the striker casting by a wear plate through the use of prongs which extend downwardly from the plate through openings in both the spacer and striker casting.

4 Claims, 5 Drawing Figures

STRIKER CARRIER HAVING AN ADJUSTABLE WEAR PLATE FOR A RAILWAY COUPLER

BACKGROUND OF THE INVENTION

This invention relates to a striker carrier for a railway coupler and more particularly to a wear-resistant casting forming a load-bearing member having downwardly extending protrusions that can engage a bottom carrier section while shims or other form of spacers are positioned between the casting and the bottom section to adjustably position a railway coupler while resiliently supported on the casting. The striker carrier of the present invention is particularly useful for supporting an AAR standard E-type coupler or an AAR interlocking F-type coupler.

It is a usual practice to provide a combined car coupler striker and front draft lug casting the includes a carrier and is secured to a car sill of a railway vehicle to support the coupler for horizontal pivotal movement at a desired elevation. Examples of a striker carrier for an E-type coupler can be found in U.S. Pat. Nos. 4,327,839 and 4,345,689 and examples of a striker carrier for an F-type coupler can be found in U.S. Pat. Nos. 2,515,964; 2,556,732; 2,604,215; 4,133,434; 4,445,618; and 4,345,689. The carrier arrangement for an E-type coupler comprises an integral cast rigid structure generally protected by a high wear-resistant material in the form of a plate-like insert. An anti-friction wear surface such as a polometric sheet has been attached to the top surface of the insert for contact with the shank wear plate on an E-type coupler. In a similar way, an anti-friction sheet or insert has been provided on a resiliently supported carrier for an F-type coupler. The F-type carrier arrangement includes a carrier casting supported by springs to slide vertically in a cage-like appendage attached to the lower part of the striker. Carriers of known design fail to provide an effective means for adjusting the elevation at which the coupler is supported. It is a usual practice to attach by weld metal a wear plate to the bottom wall of the shank portion of a coupler. The shank which extends through a striker opening is connected at its butt end portion to a yoke of a draft gear assembly. The wear plate is situated on the shank portion to engage with a carrier supported by a striker casting. In a standard E-type coupler, the striker casting is formed with a central opening surrounded by a striking face in a vertical plane with the coupler shank extending through the casting so that the wear plate rests on the cast carrier member of the striker casting. Efforts have been made in the past to improve the wear-resistant property of the coupler carrier wear plate by producing the carrier or carrier wear plates from manganese steel, however such methods have failed in affording coupler shank height adjustments without effecting the vertical angling requirements of the coupler shanks. Moreover, all efforts to weld manganese steel to the cast steel material of the striker have not meet with success.

The coupler shank wear plate which is welded to the shank portion of the coupler distorts during the welding process and can wear during use from a normal ¼ inch thickness down to about a 1/16 of an inch. During the wearing process the wear plate cracks under loading by the coupler in service. The plate can then break loose and separate from the shank eventually falling to the road bed. Not only is the shank left unprotected, but also the coupler head drops from its desired elevation rendering coupling operations difficult to perform. It is desirable to increase the bottom wall thickness of the coupler shank and eliminate the trouble plagued use of a wear plate. It is further desirable to accurately adjust the height of the shank portion of the coupler to effectively eliminate variations to the height dimension of a coupler shank including a wear plate on the shank portion having different thicknesses as well as variations to dimensions of the striker casting that effect height of the coupler shank. Present designs of AAR F-type couplers are also provided with a striker casting which includes a striker face in a vertical plane surrounding an opening through which the shank portion of the coupler extends for connection to a yoke forming part of a draft gear. The bottom wall of the striker is provided with an extended portion having a pocket therein containing springs which resiliently support a striker carrier. The carrier has lugs projecting from lateral sides thereof to engage with stops which are arranged to project into the pocket. The springs urge the carrier upwardly against the retainer lug stops and present the top surface of the carrier at an elevation which is fixed by the stops for engagement with the wear plate on the shank portion of the F-type coupler. Thus again it is not possible to adjustably elevate the shank portion of the coupler without affecting angling requirements. Wear of the coupler wear plate as well as the striker carrier and/or carrier wear plate permits a downward angling of the shank portion which is particularly detrimental in an F-type coupler because of the interlocking feature of the coupler head.

SUMMARY OF THE INVENTION

It is an object of the present invention to provide a striker carrier for supporting the shank portion of a coupler for a railway vehicle at an adjustable and preestablished elevation by the use of one or more insert elements which can be changed from time to time to compensate for wear and distortion of parts that affect the height of the shank portion and coupler head attached thereto during operation of the railway vehicle.

It is a further object of the present invention to provide a design of a striker carrier for the shank portion of a coupler which can effectively accommodate shank portions with the attending wear of a wear plate or elimination of the wear plate by a thickening of the wall of the shank portion of the coupler.

According to the present invention there is provided a carrier in combination with a striker to angularly position a railroad car coupler at an adjustably preestablished elevation for horizontal swinging of the coupler, the striker including a bottom carrier section having a load bearing face surface underlying the railroad coupler, a spacer element on the bottom carrier section, and a carrier wear plate comprised of wear-resistant metal forming a horizontal coupler support face, the carrier wear plate including depending members extending downwardly beyond the spacer element for interlocking engagement with the bottom carrier section.

For a F-type coupler, according to the present invention, there is provided a striker carrier where plate assembly for the shank portion of a coupler of a railway vehicle wherein the assembly includes a carrier casting having a load-bearing surface arranged to extend in a generally horizontal plane underlying a shank portion of the railway coupler shank and an upper carrier wear plate comprised of wear-resistant material forming a horizontal coupler support face which is adjustable vertically by means interposed between the wear plate and the carrier casting.

Preferably, the means for adjusting the vertical elevation of the carrier wear plate comprises one or more spacer members such as shims that are held captive between the wear plate and carrier casting by the configuration of the wear plate. In an E-type coupler, the carrier is cast as an integral part of the striker casting and the wear plate is provided with retainer lugs to engage opposite portions of the carrier casting. The retainer lugs have a sufficient height to maintain effective contact with the carrier casting with spacing means interposed therebetween. In an F-type coupler, the carrier casting is resiliently supported by springs in a pocket formed by walls depending from the striker. Retainer lugs project into the pocket to engage with the carrier casting for establishing a predetermined elevation of a load-bearing surface of the carrier assembly. The load-bearing surface of the carrier casting is preferably provided with spaced apart openings into which prongs are received that extend from the overlying surface of the wear plate. Spacers are provided with openings that can align with the openings in the carrier casting to permit free passage of the prongs through the spacers and into the carrier casting to prevent accidental loss of the spacers.

These features and advantages of the present invention as well as others will be more fully understood when the following description is read in light of the accompanying drawings of which:

Figure 1:
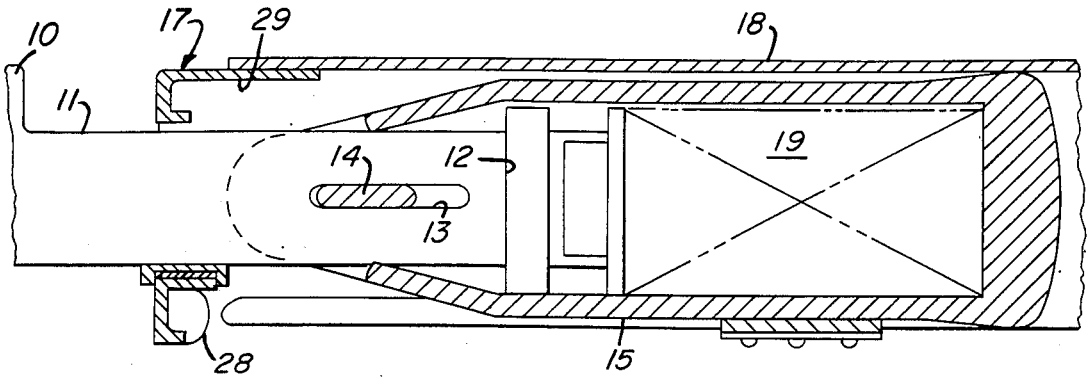
FIG. 1 is an elevational view, partly in section, of an E-type coupler arrangement including the striker and improved striker carrier of the present invention.
Figure 2:
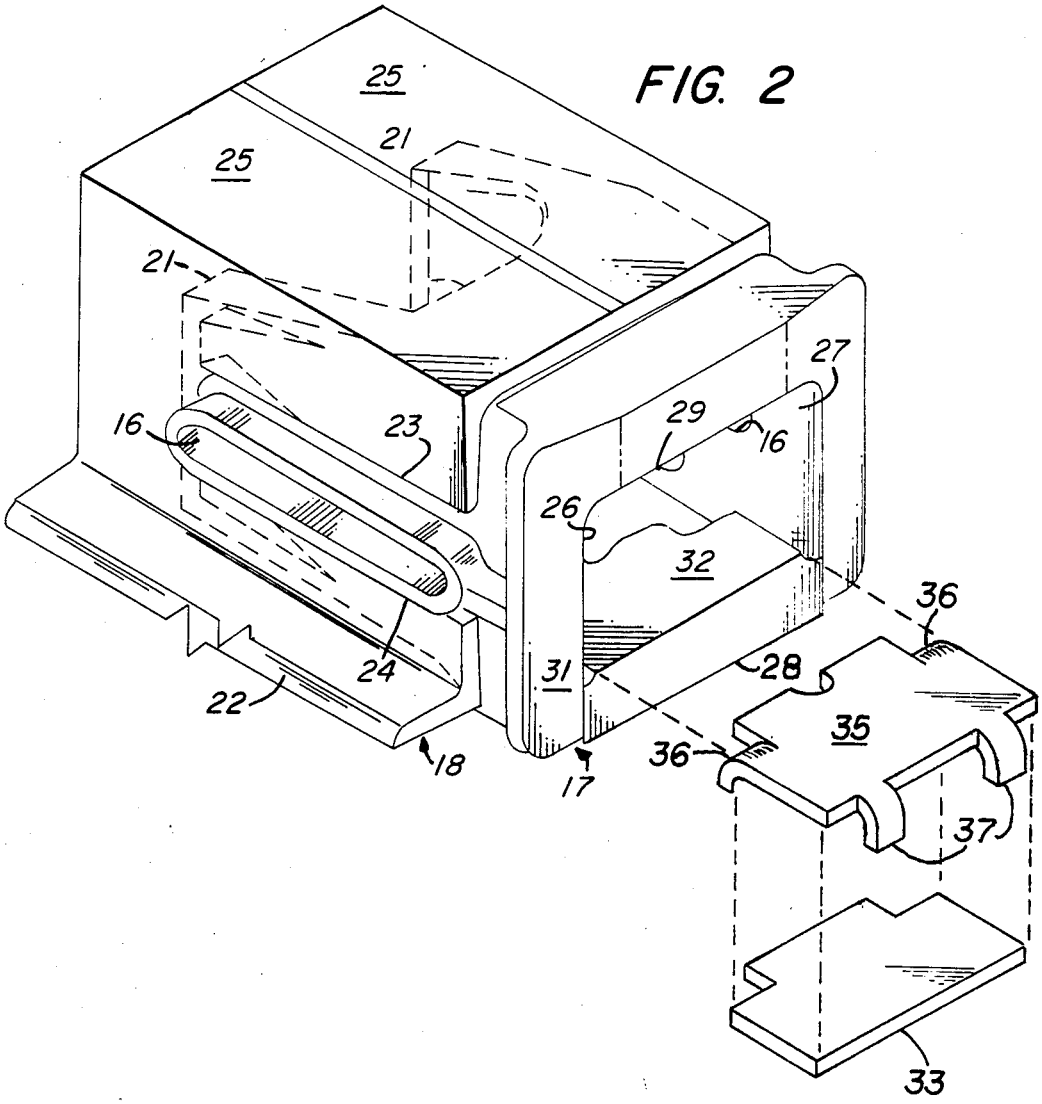
FIG. 2 is an exploded isometric view of a Z-sill for a railway vehicle together with the striker; striker carrier of the present invention shown in FIG. 1.

In FIG. 1 of the drawings, there is illustrated an E-type railway coupler assembly that includes a coupler head 10 constructed in a manner, per se, well known in the art. Extending rearwardly of the coupler head is a coupler shank 11 having a butt end 12 and a horizontal key slot 13 in the rear portion thereof. A draft key 14 extends through the key slot and projects from opposite sides of the coupler shank outwardly through openings in the nose portion of a yoke 15. The draft key also extends through key-slot openings 16 in a striker casting 17. The striker casting is secured by weld metal, preferably in the manner described in U.S. Pat. No. 4,445,617, to a sill 18. To lessen the impact forces between the coupler and the Z-sill, the usual draft gear 19 is arranged in a draft gear pocket formed in the coupler yoke 15. The draft gear is seated against a draft gear face at the rear part of the yoke and follower blocks that are interposed between the draft gear and front draft lugs 21 of the striker casting 17. The sill 18 may take the form of any well-known sill configuration. The sill shown in FIGS. 1 and 2 is a Z-sill made up of two Z-shaped sections having flange portions 22. The sill is attached to part of the fabricated construction of the underframe of the car. Upstanding side sill portions each includes a horizontal slot 23 in which a rib 24 of the striker casting extends. The striker casting is welded to the sill about the periphery of the ribs. The side portions of the sill extend to top portions 25 which are welded together along their longitudinal edges so that a pocket is formed for receiving the striker casting 17.

The striker casting includes spaced apart side walls 26 and 27 joined together along their forward bottom portion by a wall commonly referred to as a coupler carrier 28. A top wall 29 is formed across the top of the casting above the coupler carrier. The side walls, top wall and coupler carrier have a flange section which forms a generally rectangular continuous striker face 31.

Face surface 32 of the coupler carrier inside the striker casting is directed toward the shank of the coupler has an elongated configuration in a horizontal plane. It is preferred according to the present invention, to arrange the coupler carrier at a site which is lower than conventional, e.g., ⅛ inch, to provide space for accommodating a spacer 33. The spacer is placed on the face surface 32. The spacer has a T-shaped configuration as shown in FIG. 2. Placed on top of the spacer 33, as shown in FIG. 2, is a wear plate 35 which has an elongated configuration and can be made from cast manganese steel. However, rolled steel plate can also be used for fabricating or forging the wear plate. The manganese steel, preferably Hadfield's manganese steel has a composition of 11–14 percent manganese, 1.1–1.4 percent carbon, 0.10–0.30 percent silicon, 0.01–0.03 percent sulfur, and not more than 0.06 phosphorus. The upper face surface of the striker carrier when comprised of this manganese steel has excellent wear properties which have low abrasion to the shank portion of the coupler irrespective of whether a wear plate is provided on the coupler shank for contact with the striker carrier. When a shank wear plate is eliminated, the bottom wall of the coupler shank is provided with an increased thickness. The spacer 33 is held captive in a pocket of the wear plate 35 formed by a depending rear wall section 36 and a depending front wall section 37. The wear plate 35 captivly engages the coupler carrier by the interlocking arrangement of walls sections 36 and 37 with the rear and front carrier edges respectively. The thickness of spacer 34 which can be increased or decreased from time to time by adding or replacing spacers to support the coupler shank at a desired elevation so that the coupler head can properly engage with a mating coupler.

Figure 3:
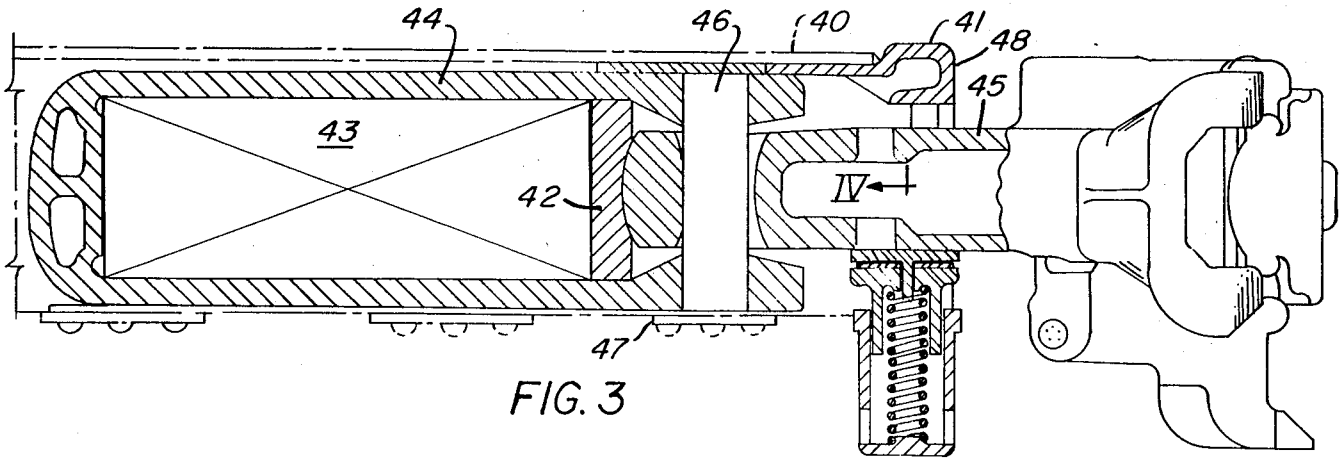
FIG. 3 is an elevational view partly in section of a F-type coupler arrangement including a striker carrier support according to the present invention.
Figure 4:
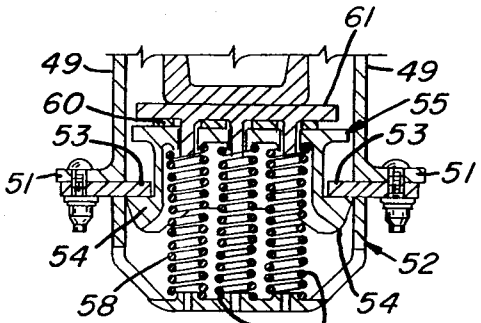
FIG. 4 is a partial sectional view taken along line IV–VI of FIG. 3.
Figure 5:
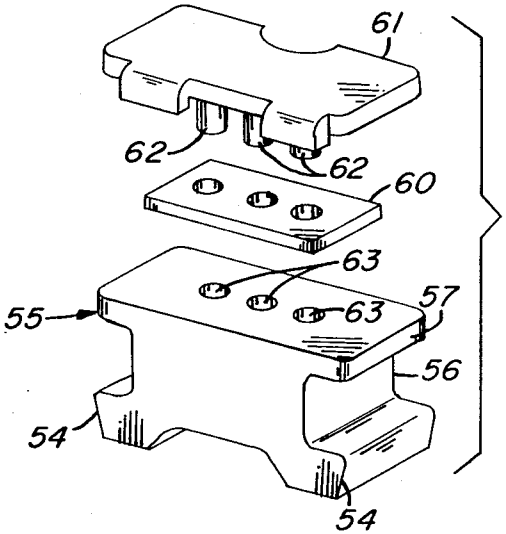
FIG. 5 is an exploded view of the arrangement of parts forming an embodiment of striker carrier shown in FIGS. 3 and 4.

In FIGS. 3–5 there is illustrated an AAR F-type interlocking coupler which is connected for support by a center sill 40 that is a integral part of an railway car body. The center sill is of a conventional design, per se well known in the art, and connected to a terminal end portion thereof is a conventional striker casting 41. The casting includes the usual forward draft gear stop lugs against which is seated a front follower 42 which in turn contacts a conventional draft gear 43. The draft gear is situated within an opening of a yoke 44 which is connected to the shank portion 45 of a coupler having an interlocking F-type coupler head. The coupler shank is connected to the yoke by a pin 46. The pin is held in place by a plate 47 secured across the center sill. The striker casting 41 has a vertically disposed striker portion 48 with a planer front face extending above the periphery of the central opening into which the shank portion of the coupler extends. As can be seen from FIGS. 3 and 4 the striker includes a top wall from which side walls 49 extend downwardly to a point where outwardly extending flanges 51 are provided for connecting a striker cage 52 to the flange. At the top of the striker cage there is a flange extending both outwardly and inwardly from walls of the striker cage. The outwardly extending portions of the flange are connected by fasteners to the flange of the side walls of the striker. The inwardly extending portions of the flange form stops 53 which engage with lugs 54 formed on the lower portion of a bottom carrier casting 55. The bottom lugs as shown in FIG. 7 on the carrier casting are connected by a waist portion 56 to a top wall portion 57. The waist area is formed by side wall sections that surround a hollow cavity in which springs 58 extend vertically and urge the casting upwardly. The top end portion of the springs receive positioning bosses that are formed on the under surface of the top wall portion 57. Other positioning bosses are formed on the bottom wall of the cage to support the springs. The springs 58 are constructed to exert a sufficient force on the casting so that the bottom lug 54 contacts the stops 53 and determine the position of the top wall portion 57 during operation of the coupler when downwardly directed forces are not applied to the striker casting. The present invention provides means for establishing desired elevation at which the shank portion of the coupler is supported. Because of dimensional differences to the wall thickness of the shank portion and wear of the shank, it is desirable to adjust from time to time the elevation at which the striker casting supports the shank of the coupler. For this purpose, a spacer member 60 having a generally rectangular shape and a thickness which is selected according to the necessary increase to the elevation at which the shank is supported. The spacer is retained in a positive manner on the top wall portion 57 of the striker casting by a wear plate 61. The wear plate is made of manganese steel of the same composition as the wear element for the E-type coupler described hereinbefore. Depending from the underside of the wear element are spaced apart prongs 62 which can pass through suitably spaced openings in the spacer and into openings 63 in the top wall portion 57 of the striker casting. The prongs have a generally rod-shaped configuration so that they can freely pass through into a center portion of the springs without interfering with their normal function. To further facilitate retention of the wear element and the spacer on the striker casting of the wear element is provided with a downwardly extending lugs 64 that pass across the edge of the spacer and along the vertical side face of the striker casting.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A carrier supported in a chamber of a striker to resiliently position a railroad car coupler at an adjustable preestablished elevation for horizontal swing of the coupler, said carrier comprising, a bottom carrier section resiliently supported against vertically located retainer lugs in said chamber, said bottom carrier section including a load-bearing face surface having prong openings therein underlying said railroad car coupler, a spacer having a predetermined thickness and prong openings aligned within the prong openings in the bottom carrier section, and an upper carrier casting comprised of wear-resistant material for forming a horizontal coupler support face, said upper carrier casting including depending prongs having a consistent cross section vertically to permit restricted freedom of motion to travel in a vertical direction for extending through the prong openings in said spacer and into the prong openings of said bottom carrier section irrespective of the predetermined thickness of the spacer.

2. The combination according to claim 1 wherein the metal material of the wear plate engages in load bearing contact with the shank of said coupler which comprises a cast metal section.

3. The combination according to claim 2 wherein the wear-resistant metal of said carrier casting is manganese steel.

4. A carrier supported in a chamber of a striker to resiliently position a railroad car coupler at an adjustably preestablished elevation for horizontal swinging of the coupler, said carrier comprising, a bottom carrier section resiliently supported against vertically located retainer lugs in said chamber, said bottom carrier section including a load-bearing face surface underlying said railroad car coupler, said load-bearing face surface including retainer openings, a spacer element having spacer element retainer openings and a predetermined thickness which is selected to establish an elevation for horizontal swings of the coupler on said bottom carrier section, and an upper carrier casting comprised of wear-resistant material forming a horizontal coupler support face, said upper carrier casting overlying said spacer element, said upper carrier casting including a plurality of retainer members projecting therefrom and through said spacer element retainer openings and into the retainer openings in said load-bearing face surface, said retainer members having a consistent cross section vertically to permit restricted freedom of motion to travel in a vertical direction to hold said upper carrier casting and said spacer element in a superimposed relation on said bottom carrier section irrespective of the predetermined thickness of the spacer element.

* * * * *